US010199024B1

(12) United States Patent
Abel et al.

(10) Patent No.: US 10,199,024 B1
(45) Date of Patent: Feb. 5, 2019

(54) MODAL PROCESSOR EFFECTS INSPIRED BY HAMMOND TONEWHEEL ORGANS

(71) Applicants: Jonathan S. Abel, Menlo Park, CA (US); Kurt James Werner, Stanford, CA (US)

(72) Inventors: Jonathan S. Abel, Menlo Park, CA (US); Kurt James Werner, Stanford, CA (US)

( * ) Notice: Subject to any disclaimer, the term of this patent is extended or adjusted under 35 U.S.C. 154(b) by 0 days.

(21) Appl. No.: 15/610,333

(22) Filed: May 31, 2017

Related U.S. Application Data

(60) Provisional application No. 62/344,293, filed on Jun. 1, 2016.

(51) Int. Cl.
*G10H 1/04* (2006.01)
*G10H 1/08* (2006.01)
*G10H 1/02* (2006.01)

(52) U.S. Cl.
CPC ..... *G10H 1/08* (2013.01); *G10H 1/02* (2013.01); *G10H 1/04* (2013.01)

(58) Field of Classification Search
CPC .. G10H 3/12; G10H 3/14; G10H 1/06; G10H 1/045; G10H 1/04; G10H 1/02
USPC ..... 84/625, 624, 694, 735
See application file for complete search history.

(56) References Cited

U.S. PATENT DOCUMENTS 1,947,020 A * 2/1934 Ranger ..... G10H 3/16 84/736
2,035,836 A * 3/1936 Ranger ..... G10H 1/06 84/694
2,322,884 A * 6/1943 Roetken ..... G10H 1/043 330/109
2,340,213 A * 1/1944 Ellsworth ..... G08G 1/01 235/99 A
2,429,229 A * 10/1947 Koenig, Jr. ..... G10L 21/06 324/76.12
2,756,336 A * 7/1956 Christensen ..... H03J 7/04 324/76.74
2,817,711 A * 12/1957 Feldman ..... H04B 1/667 704/205
2,871,745 A * 2/1959 Scott ..... G10H 1/04 84/705
2,989,886 A * 6/1961 Markowitz ..... G10H 1/14 331/185
3,136,853 A * 6/1964 Bissonette ..... G10K 15/10 333/146
3,178,502 A * 4/1965 Clark, Jr. ..... G10H 1/045 84/641
3,267,197 A * 8/1966 Hurvitz ..... G10K 15/10 84/705

(Continued)

*Primary Examiner* — David Warren
(74) *Attorney, Agent, or Firm* — Foley & Lardner LLP

(57) ABSTRACT

Methods and apparatuses according the present embodiments derive the sound of a Hammond tonewheel organ from the equal-tempered tuning of its tonewheels and drawbar registration design, as well as its vibrato/chorus processing and pickup distortion. In embodiments, as a reverberation effect, the modal processor simulates a room response as the sum of resonant filter responses, providing precise, independent and interactive control over the frequency, damping, and complex amplitude of each mode. As an effects processor, the modal processor provides pitch shifting and distortion by simple manipulations of the mode output sinusoids.

13 Claims, 12 Drawing Sheets
(12 of 12 Drawing Sheet(s) Filed in Color)

(56) References Cited

U.S. PATENT DOCUMENTS

| | | | | | |
|---|---|---|---|---|---|
| 3,267,198 | A * | 8/1966 | Hurvitz | A23D 9/02 | 84/706 |
| 3,267,199 | A * | 8/1966 | Hurvitz | G10H 1/043 | 84/696 |
| 3,355,539 | A * | 11/1967 | Munch, Jr. | G10H 1/06 | 327/115 |
| 3,372,225 | A * | 3/1968 | Leslie | G10H 1/045 | 84/706 |
| 3,476,866 | A * | 11/1969 | Cunningham | G10H 1/14 | 84/701 |
| 3,499,093 | A * | 3/1970 | Munch, Jr. | G10H 1/08 | 84/692 |
| 3,510,565 | A * | 5/1970 | Morez | G10H 5/08 | 84/698 |
| 3,644,657 | A * | 2/1972 | Miller | G10H 1/04 | 84/705 |
| 3,840,689 | A * | 10/1974 | Nakada | G10H 5/06 | 84/648 |
| 6,208,969 | B1 * | 3/2001 | Curtin | G10H 1/125 | 704/258 |
| 6,259,014 | B1 * | 7/2001 | Qian | G10H 1/125 | 84/625 |
| 9,805,704 | B1 * | 10/2017 | Abel | G10H 5/02 | |
| 2004/0002315 | A1 * | 1/2004 | Lin | G10H 5/002 | 455/255 |
| 2015/0194141 | A1 * | 7/2015 | Bao | H03D 7/02 | 381/119 |

* cited by examiner

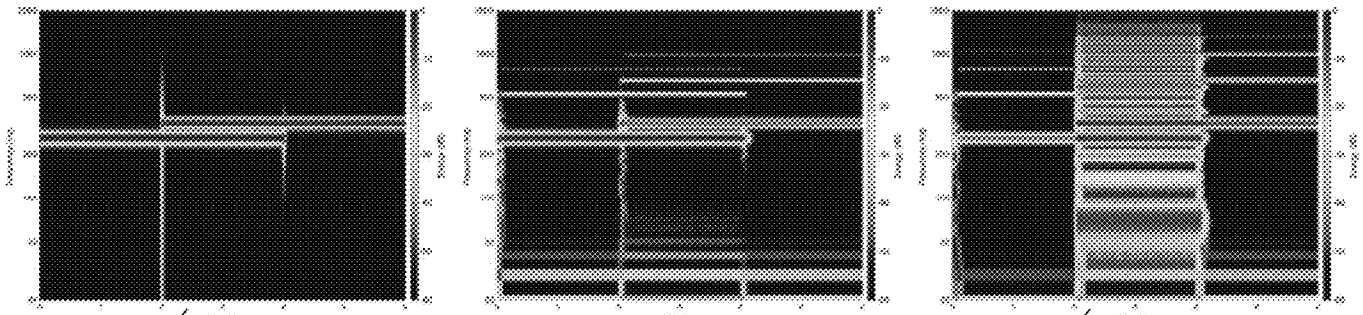
Figure 14(a)
1402
Figure 14(b)
1404
Figure 14(c)
1406
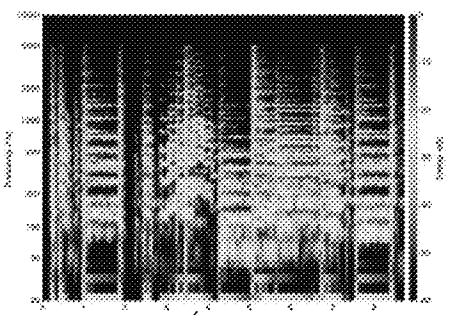
Figure 15(a)
1502
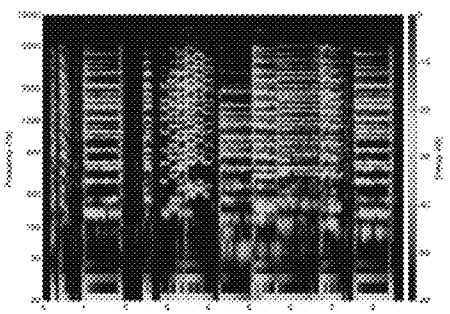
Figure 15(b)
1504
Figure 15(c)
1506

1602

1604

1606

MODAL PROCESSOR EFFECTS INSPIRED BY HAMMOND TONEWHEEL ORGANS

CROSS-REFERENCE TO RELATED APPLICATIONS

The present application claims priority to U.S. Provisional Patent Application No. 62/344,293 filed Jun. 1, 2016, the contents of which are incorporated by reference herein in their entirety.

TECHNICAL FIELD

The present embodiments relate generally to audio signal processing, and more particularly to applying modal processor effects inspired by Hammond tonewheel organs.

BACKGROUND

The Hammond tonewheel organ is a classic electromechanical musical instrument, patented by Laurens Hammond in 1934. Though intended as an affordable substitute for church organs, it has also become an essential part of jazz (where it was popularized by Jimmy Smith), R&B, and rock music (where the Hammond playing of Keith Emerson of Emerson, Lake & and Palmer and Jon Lord of Deep Purple is exemplary). The sound of the Hammond organ is rich and unusual, owing to its unique approach to timbre and certain quirks of its construction.

It would be desirable to imprint the unique sonics of Hammond tonewheel organs on input audio, for example to "Hammondize" a guitar or flute. In other words, it would be desirable to provide an audio effect that could impart the sonic character of a Hammond tonewheel organ to any sound. It is also desirable to apply such an effect digitally, with a minimum of computation.

SUMMARY

According to certain aspects, the present embodiments derive the sound of a Hammond tonewheel organ from the equal-tempered tuning of its tonewheels and drawbar registration design, as well as its vibrato/chorus processing and pickup distortion. In embodiments, as a reverberation effect, the modal processor simulates a room response as the sum of resonant filter responses, providing precise, independent and interactive control over the frequency, damping, and complex amplitude of each mode. As an effects processor, the modal processor provides pitch shifting and distortion by simple manipulations of the mode output sinusoids.

In one embodiment of the present invention, a modal processor architecture is employed to produce pitch shifts and vibrato which mimic the effect of the equal tempered tonewheels, drawbar tone controls and vibrato/chorus circuit. In another embodiment, a modal processor architecture is adapted to generate distortion similar to that produced by the pseudo-sinusoidal shape of the tonewheels and electromagnetic pickup distortion.

In another embodiment, the modal processor architecture includes a set of equal tempered input and output mode frequencies, and incorporates heterodyning, smoothing and modulation steps, as well as a matrix which routes heterodyned modes to multiple modulation inputs, according to the registration. Further embodiments include smoothing processes applied before and/or after the routing. By incorporating a routing matrix—-made possible by the equal tempered mode frequency tuning—the modulators are re-used, saving computation.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

These and other aspects and features of the present embodiments will become apparent to those ordinarily skilled in the art upon review of the following description of specific embodiments in conjunction with the accompanying figures, wherein:

FIGS. 14(*a*) to 14(*c*) are spectrograms illustrating the presence of intermodulation distortion in embodiments of the Hammondizer process;

FIGS. 15(*a*) to 15(*c*) are spectrograms illustrating full Hammondizer processing program material with a guitar according to embodiments;

DETAILED DESCRIPTION

Figure 1:
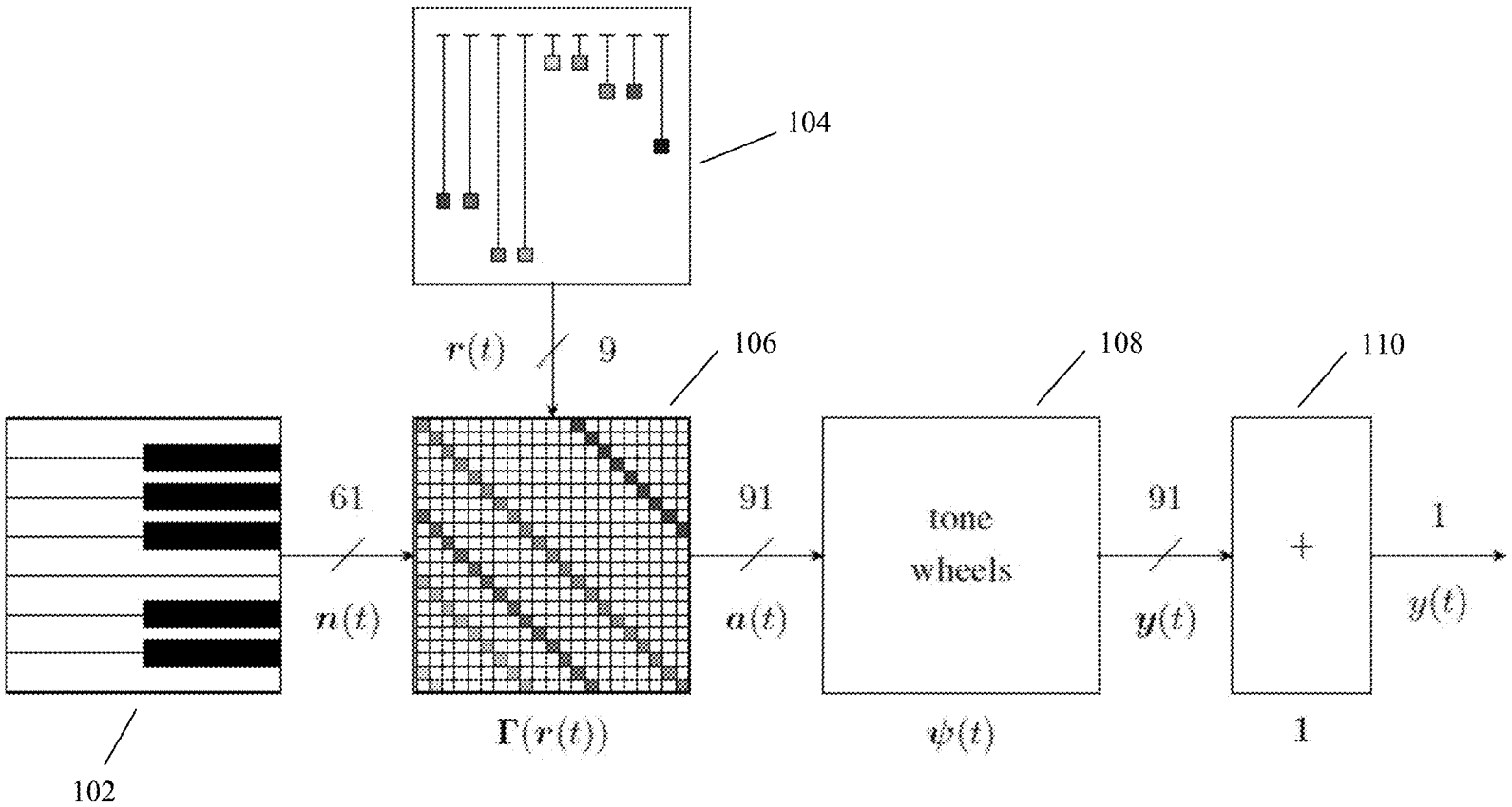
FIG. 1 is a block diagram of a vector version of a Hammond Tonewheel Organ according to embodiments.

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

The present applications recognize various aspects of the Hammond tonewheel organ. First of all, it is a classic electromechanical musical instrument, patented by Laurens Hammond in 1934 (L. Hammond, "Electrical musical instrument," U.S. Pat. No. 1,956,350, Apr. 24, 1934). Although it was intended as an affordable substitute for church organs (see, e.g., T. K. Ng. "The Heritage of the Future: Historical Keyboards, Technology, and Modernism," Ph.D), it has also become widely known as an essential part of jazz (where it was popularized by Jimmy Smith), R&B, and rock music (where the Hammond playing of Keith Emerson of Emerson, Lake& and Palmer and Jon Lord of Deep Purple is exemplary). The most popular model is the Hammond Hammond B-3, although many other models exist (see, e.g., Faragher, "The Hammond organ: an introduction to the instrument and the players who made it famous," Hal Leonard Books, Milwaukee, Wis., USA, 2011). The sound of the Hammond organ is rich and unusual. Its complexity comes from the Hammond organ's unique approach to timbre and certain quirks of its construction.

In general, the present embodiments relate to a novel class of modal-processor-based audio effects referred to herein as the "Hammondizer." The Hammondizer can imprint the sonics of the Hammond organ onto any sound; it mimics and draws inspiration from the architecture of the Hammond tonewheel organ. The present disclosure begins by describing the architecture and sonics of the Hammond tonewheel organ alongside related work on Hammond organ modeling.

The Hammond organ is essentially an additive synthesizer. Additive synthesizers create complex musical tones by adding together sinusoidal signals of different frequencies, amplitudes, and phases (see, e.g., J. O. S. III, "Spectral Audio Signal Processing," Online book, 2011 edition. https://ccrma.stanford.edu/~jos/sasp/Additive_Synthesis_Early_Sinusoidal.html). In the Hammond organ, 91 sinusoidal signals are available. These sinusoids are created when "tonewheels"—ferromagnetic metal discs—spin and the pattern of ridges cut into their edges is transduced by electromagnetic pickups into electrical signals, a technique originated in Thaddeus Cahill's late-19th century instrument, the Telharmonium (see, e.g., H. Bode, "History of electronic sound modification," Journal of the Audio Engineering Society (JAES), 32(10):730-739, October 1984). Hammond organ tonewheel pickups have not been studied much in particular, but modeling and simulation of electromagnetic pickups in general is an active research area (see, e.g., K. Ebeling, K. Freudenstein, and H. Alrutz, "Experimental investigation of statistical properties of diffuse sound fields in reverberation rooms," Acta Acustica united with Acustica, 51(3):145-153, (1982); L. Gabrielli, V. Valima, H. Penttinen, S. Squartini, and S. Bilbao, "A digital waveguide-based approach for Clavinet modeling and synthesis," EURASIP Journal on Advances in Signal Processing, (103), (2013); T. Jungmann, "Theoretical and practical studies on the behaviour of electric guitar pickups," Diploma thesis, Helsinki University of Technology, Helsinki, Finland, November 1994; M. Mustonen, D. Kartofelev, A. Stulov, and V. Välimäki. "Experimental verification of pickup nonlinearity," Proceedings of the International Symposium on Musical Acoustics (ISMA), pages 651-656, Le Mans, France, Jul. 7-12, 2014; L. Remaggi, L. Gabrielli, R. C. D. de Paiva, and S. Välimäki, Vesa, "A pickup model for the Clavinet," Proceedings of the 15th International Conference on Digital Audio Effects (DAFx-12), York, UK, Sep. 17-21, 2012). Any nonlinearities in a pickup model will cause bandwidth expansion and add to the characteristic sound of the Hammond organ. In the case that this bandwidth expansion would go beyond the Nyquist limit, alias-suppression methods become relevant (see, e.g., H. T. Carvalho, F. R. Avila, and L. W. P. Biscainho, "Baysian suppression of memoryless nonlinear audio distortion," Proceedings of the 23rd European Signal Processing Conference (EUSIPCO), pages 1063-1067, Nice, France, Aug. 31-Sep. 4, 2015; F. Esqueda, V. Välimäki, and S. Bilbao, "Aliasing reduction in soft-clipping algorithms," Proceedings of the 23rd European Signal Processing Conference (EUSIPCO), pages 2059-2063, Nice, France, Aug. 31-Sep. 4, 2015; N. G. Horton and T. R. Moore, "Modeling the magnetic pickup of an electric guitar," American Journal of Physics, 77(2):144-150, 2009; R. C. D. Paiva, J. Pakarinen, and V. Välimäki, "Acoustics and modeling of pickups," Journal of the Audio Engineering Society (JAES), 60(10):768-782, October 2012; H. Thornburg, "Antialiasing for nonlinearities: Acoustic modeling and synthesis applications," Proceedings of the International Computer Music Conference (ICMC), Beijing, China, 1999).

These 91 tonewheels are tuned approximately to the twelve-tone equal-tempered musical scale (see, e.g., http://electricdruid.net/technical-aspects-of-the-hammond-organ/). In scientific pitch notation, the lowest-frequency tonewheel on a Hammond organ is tuned to C1 (approximately 32.7 Hz) and the highest-frequency tonewheel is tuned to F#7 (approximately 5919:9 Hz) (see, e.g., http://www.goodeveca.net/RotorOrgan/ToneWheelSpec.html). The lowest octave of tonewheels do not form sinusoids, but more complex tones that have strong 3rd and 5th harmonics, making them closer to square waves than sine waves (see, e.g., http://electricdruid.net/technical-aspects-of-the-hammond-organ/). Some aficionados have pointed to crosstalk between nearby tonewheel/pickup pairs as an important sonic feature of the Hammond organ (see, e.g., J. Pekonen, T. Pihlajamäki, and V. Välimäki, "Computationally efficient Hammond organ synthesis," Proceedings of the 14th International Conference on Digital Audio Effects (DAFx-11), Paris, France, Sep. 19-23, 2011; G. Reid, "Synthesizing Hammond organ effects: Part 1," Sound on Sound (SOS), January 2004).

The tone of the Hammond organ is set using nine "drawbars." Unlike traditional organs, where "stops" bring in entire complex organ sounds, the Hammond organ's drawbars set the relative amplitudes of individual sinusoids in a particular timbre. These nine sinusoids form a pseudo-harmonic series summarized in Table 1 below (see, e.g., http://www.hammond-organ.com/product_support/drawbars.htm). This pseudo-harmonic series deviates from the standard harmonic series in three ways: 1. each overtone is tuned to the nearest available tonewheel; 2. certain overtones are omitted, especially the 6th harmonic which would be between the 8th and 9th drawbar); and 3. new fictitious overtones are added (the 5th and sub-octave).

Recently, Pekonen et al. presented a novel Leslie model (see, e.g., J. Pekonen, T. Pihlajamäki, and V. Välimäki, "Computationally efficient Hammond organ synthesis," Proceedings of the 14th International Conference on Digital Audio Effects (DAFx-11), Paris, France, Sep. 19-23, 2011) using spectral delay filters (see, e.g., V. Välimäki, J. S. Abel, and J. O. Smith, "Spectral delay filters," Journal of the Audio Engineering Society (JAES), 57(7/8):521-531, July/August 2009). Werner and Dunkel used theWave Digital Filter approach to model the Hammond vibrato/chorus circuit (see, e.g., K. J. Werner, W. R. Dunkel, and F. G. Germain, "A computational model of the Hammond organ vibrato/chorus using wave digital filters," Proceedings of the 19th International Conference on Digital Audio Effects (DAFx-16), Brno, Czech Republic, Sep. 5-9, 2016).

TABLE 1

Hammond Organ Drawbars-Pitch in organ stop lengths and musical intervals.

| Pipe Pitch | 16' | 5⅓' | 8' | 4' | 2⅔' | 2' | 1⅗' | 1⅓' | 1' |
|---|---|---|---|---|---|---|---|---|---|
| Scale Interval | sub-octavo | 5th | Unison | 8th | 12th | 15th | 17th | 19th | 22nd |
| Stop Name | Bourdon | Quint | Principal | Octave | Nazard | Block Flöte | Tierce | Larigot | Sifflöte |
| semitone offset | −12 | +7 | 0 | +12 | +19 | +24 | +28 | +31 | +36 |
| Error E (cents) | N/A | N/A | 0 | 0 | −1.955 | 0 | +13.686 | −1.955 | 0 |

The raw sound of the Hammond organ tonewheels is static. To enrich the sound, Hammond added a chorus/vibrato circuit (see., e.g., J. M. Hanert, "Electrical musical apparatus," Aug. 14, 1945. U.S. Pat. No. 2,382,413.). Earlier models used a tremolo effect in place of the chorus/vibrato circuit (see, e.g., D. J. Leslie, Rotatable tremulant sound producer, 1949). The sound was further enriched by an electro-mechanical spring reverb device (see, e.g., H. E. Meinema, H. A. Johnson, and W. C. Laube Jr., "A new reverberation device for high fidelity systems," Journal of the Audio Engineering Society, 9(4):284-326, October 1961). Although Hammond did not originally approve of the practice, it became customary to play Hammond organs through a Leslie speaker, an assembly with a spinning horn and baffle the creates acoustic chorus and tremolo effects. The Leslie speaker has been covered extensively in the modeling literature. Various approaches have involved interpolating delay lines (see, e.g., J. Smith, S. Serafin, J. Abel, and D. Berners, "Doppler simulation and the Leslie," In Proceedings of the 5th International Conference on Digital Audio Effects (DAFx-02), Hamburg, Germany, Sep. 26-28, 2002; J. Smith III, "Physical Audio Signal Processing for Virtual Musical Instruments and Audio Effects," Online book, 2010 edition, https://ccrma.stanford.edu/~jos/pasp) Leslie.html) and amplitude modulation (see, e.g., S. Disch and U. Zölzer, "Modulation and delay line based digital audio effects," Proceedings of the 2nd COST G-6 Workshop on Digital Audio Effects (DAFx-99), Trondheim, Norway, Dec. 9-11, 1999; P. Dutilleux, M. Holters, S. Disch, and U. Zölzer, "Modulators and demodulators," chapter 3, pages 349 83-99. 2011), perception-based models (see, e.g., R. Kronland-Martinet and T. Voinier, "Real-time perceptual simulation of moving sources: Application to the leslie cabinet and 3D sound immersion," EURASIP Journal on Audio, Speech, and Music Processing, 2008. Article ID 849696), and time-varying FIR filters (see, e.g., J. Herrera, C. Hanson, and J. S. Abel, "Discrete time emulation of the Leslie speaker," Proceedings of the 127th Convention of the Audio Engineering Society (AES), New York, N.Y., USA, Oct. 9-12, 2009. Convention Paper 7925).

Although Hammond had stopped manufacturing their tonewheel organs by 1975, the Hammond sound remained influential. Many manufactures developed clones of the Hammond tonewheel organ. Commercial efforts have been accompanied by popular and academic work in virtual analog modeling (see, e.g., J. Pakarinen, V. Välimäki, F. Fontana, V. Lazzarini, and J. S. Abel, "Recent advances in real-time musical effects, synthesis, and virtual analog models," EURASIP Journal on Advances in Signal Processing, 2011. Article ID 940784). Gordon Reid wrote a series of articles for Sound on Sound on generic synthesis approaches to modeling aspects of the Hammond organ (see, e.g., G. Reid, "Synthesizing tonewheel organs," Sound on Sound (SOS), November 2003; G. Reid, "Synthesizing tonewheel organs: Part 2," Sound on Sound (SOS), December 2003; G. Reid, "Synthesizing Hammond organ effects: Part 1," Sound on Sound (SOS), January 2004; G. Reid, "Synthesizing the rest of the Hammond organ: Part 2," Sound on Sound (SOS), February 2004; G. Reid, "Synthesizing the rest of the Hammond organ: Part 3," Sound on Sound (SOS), March 2004). Pekonen et al. studied efficient methods for digital tonewheel organ synthesis (see, e.g., J. Pekonen, T. Pihlajamäki, and V. Välimäki, "Computationally efficient Hammond organ synthesis," Proceedings of the 14th International Conference on Digital Audio Effects (DAFx-11), Paris, France, Sep. 19-23, 2011).

According to some aspects, the Hammondizer audio effect is implemented as an extension to the "modal reverberator" approach to artificial reverberation (see, e.g., U.S. patent application Ser. Nos. 14/558,531 and 15/201,013, the contents of which are incorporated herein by reference in their entirety; J. S. Abel, S. Coffin, and K. S. Spratt, "A modal architecture for artificial reverberation," The Journal of the Acoustical Society of America, 134(5):4220, 2013; J. S. Abel, S. Coffin, and K. S. Spratt, "A modal architecture for artificial reverberation with application to room acoustics modeling," Proceedings of the 137th Convention of the Audio Engineering Society (AES), Los Angeles, Calif., Oct. 9-12, 2014; J. S. Abel and K. J. Werner, "Distortion and pitch processing using a modal reverb architecture," Proceeding of the 18th International Conference on Digital Audio Effects (DAFx-15), Trondheim, Norway, Nov. 30-Dec. 3, 2015; V. Välimäki, J. D. Parker, L. Savioja, J. O. Smith, and J. S. Abel, "More than fifty years of artificial reverberation," Proceedings of the 60th International Conference of the Audio Engineering Society (AES), Leuven, Belgium, Feb. 3-5, 2016). Although there are many other approaches to modal sound synthesis in the literature (e.g. J. D. Morrison and J.-M. Adrien, "MOSAIC: A framework for modal synthesis," Computer Music Journal, 17(1):45-56, Spring 1993; L. Trautmann and R. Rabenstein, "Digital Sound Synthesis by Physical Modeling Using the Functional Transform Method," Springer, New York, 1st edition, 2003, chapter 4; S. Bilbao, "Numerical Sound Synthesis," chapter 1, Wiley, 2009; F. Avanzini and R. Marogna, "A modular physically based approach to the sound synthesis of membrane percussion instruments," IEEE Transactions on Audio, Speech, and Language Processing, 18(4):891-902, May 2010), the choice to extend the modal reverberator architecture to create the Hammondizer effect was a natural one for two reasons: (1) there are strong similarities between the system architecture of the Hammond organ and the system architecture of the modal reverberator; (2) the modal reverberator is already formulated as an audio effect which processes rather than synthesizes sound.

The descriptions below provide a simplified system architecture of the Hammond organ, review relevant aspects of the modal processor approach, present the novel Hammondizer digital audio effect, and thereafter provide conclusions.

Hammond Organ System Architecture

Here the present disclosure extends the qualitative description above and presents a mathematical formulation of the basic operation of the Hammond tonewheel organ. Referring to FIG. 1, the player controls the organ by depressing keys on a standard musical keyboard 102. Each of its 61 keys has a note on/off state $n_k(t)$ that is either 0 or 1 that is indexed by a key number k being an element of the set of $[1 \ldots 61]^T$. Here and in the rest of the disclosure, t is the discrete time sample index.

The timbre is controlled by 9 drawbars 104. Each drawbar has a level $r_d(t)$ that is an element of the set of [0 . . . 8], which is indexed by a drawbar number d that is an element of the set of $[1 \ldots 9]^T$. The drawbars may be changed over time to alter the sounds of the Hammond organ. Each drawbar's level $r_d(t)$ is converted to an amplitude in 3 dB increments as shown in Table 2 (e.g., according to http://www.stefanv.com/electronics/hammond_drawbar_science.html).

TABLE 2

| Amplitude of each drawbar | | | | | | | | | |
|---|---|---|---|---|---|---|---|---|---|
| $r_d$ | 0 | 1 | 2 | 3 | 4 | 5 | 6 | 7 | 8 |
| Amplitude (dB) | 0 | −3 | −6 | −9 | −12 | −15 | −18 | −18 | −∞ |

Furthermore, each drawbar has a tuning offset $o_d$ corresponding to the tuning offset in semitones of each pseudo-harmonic. The entire set of offsets is $$o=[o_1 \ldots o_9]^T=[-12,7,0,12,19,24,28,31,36]^T \quad (1)$$

Each tuning offset (except the first two) approximates a harmonic overtone. This is discussed further at the end of the section.

Each tonewheel has a frequency $f_w$ and amplitude $a_w(t)$ indexed by a tonewheel number w which is an element of the set $[1 \ldots 91]^T$. Each tonewheel is tuned to the twelve tone equal-tempered scale (in practice, there are slight deviations according to the gearing ratios, producing deviations of up to 0:69 cents, see., e.g., http://electricdruid.net/technical-aspects-of-the-hammond-organ/) according to $$f_w=440\times 2^{(w-45)/12}\ \text{Hz} \quad (2)$$

The outputs of all the tonewheels are summed by the 91×1 gain block $1=[1 \ldots 1]^T$ 110 to form the output signal y(t):

$$y(t)=1^T y(t) \quad (3)$$

The routing matrix Γ(r(t)) 106 takes in the 61-tall column of key on/off states n(t) and 9-tall column of drawbar registration r(t), and combines them to form a 91-tall column of tonewheel amplitudes a(t). This is accomplished by a matrix multiply $$a(t)=\Gamma(r(t))n(t) \quad (4)$$

Routing matrix Γ(r(t)) is sparse (i.e., most entries are 0) and has a pseudo-convolutional form (see, e.g., J. Smith III, "Mathematics of the Discrete Fourier Transform (DFT) with Audio Applications," Online book, 2007 edition. https://ccrma.stanford.edu/~jos.st.; https://ccrma.stanford.edu/~jos/mdft/Convolution.html) in which the non-zeros entries $r_1(t) \ldots r_9(t)$ which are elements of the set of [0 . . . 8] are dictated by the drawbar levels r(t). Denoting each entry in Γ(r(t)) as $\gamma_{k,w}(t)$, we have $$\gamma_{k,w}(t)=\sum_{d=1}^{9} r_d(t)\cdot\delta(w-k-o_d) \quad (5)$$

where δ(x) is the Kronecker delta function as follows:

$$\delta(x)=\begin{cases}1, & x=0\\ 0, & x\neq 0\end{cases}.$$

Figure 2:
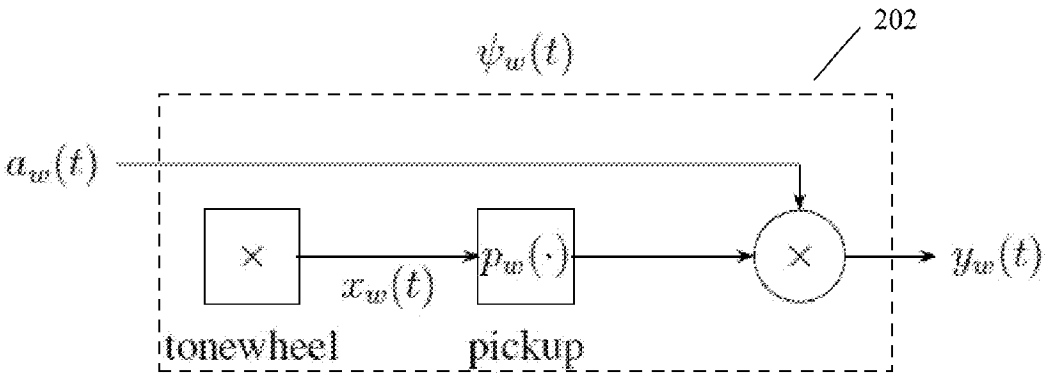
FIG. 2 is a diagram of one tonewheel processor according to embodiments.

The tonewheel block is comprised of 91 tonewheel processors $\psi_w(t)$ 106 in parallel. As shown in FIG. 2, each individual tonewheel processor has a tonewheel producing a periodic signal $x_w(t)$ at a particular frequency $f_w$, an amplitude input $a_w(t)$ provided by the routing matrix Γ(r(t)), and an electromagnetic model $p_w(\cdot)$. Each tonewheel processor forms an output $y_w(t)$ by $$y_w(t)=a_w(t)\cdot p_w(x_w(t)) \quad (7)$$

A block diagram of an individual tonewheel processor 202 is shown in FIG. 2. The matrix equation describing the entire bank of tonewheels is $$y(t)=p(x(t)\circ a(t) \quad (8)$$

where ○ is the Hadamard (elementwise) product operator $$(A\circ B)i,j=A_{ij}\cdot B_{ij} \quad (9)$$

where $A_{i,j}$ denotes the ijth element of the matrix A.

The lowest 12 tonewheels produce roughly square-wave signals and the rest produce essentially sinusoidal signals:

$$x_w(t)=\begin{cases}\frac{4}{\pi}\sin(2\pi\cdot f_w\cdot t)+\frac{4}{3\pi}\sin(2\pi\cdot 3f_w\cdot t)+\frac{4}{5\pi}\sin(2\pi\cdot 5f_w\cdot t), & w\in[1 \ldots 12]\\ \sin(2\pi\cdot f_w\cdot t), & w\in[13 \ldots 91]\end{cases}. \quad (10)$$

As a final note, the pseudo overtone series of the Hammond organ is described in more detail. Equation (5) implies a certain relationship between any pressed key k and the set of frequencies that are produced. Here we state this relationship explicitly. Given (1), (2), and (5), we can see that pressing any key k will, in general, drive a set of 9 tonewheels with frequencies $$f^{k,d}=440\cdot 2^{(k+o_d-45)/12},\ d\epsilon[1\ldots 9] \tag{11}$$

Most wind and string instruments are characterized by a harmonic overtone series, i.e., one where overtone frequencies are integer multiples of a fundamental frequency. Most of the tonewheel frequencies given in (11) approximate idealized harmonic overtones with frequencies given by $$\tilde{f}_{k,d}=410\cdot 2^{(k-45)/12}\cdot N_d,\ d\epsilon[3\ldots 9] \tag{12}$$

The first two tonewheel frequencies $f_{k,1}$ and $f_{k,2}$ are the octave below the fundamental frequency and approximately a fourth below the fundamental frequency~they are not approximations of standard harmonic overtones.

In general, $\tilde{f}_{k,d}\neq f_{k,d}$. The error in "cents" (1/100 of a semitone) is given by $$E_d=1200\log_2(\tilde{f}_{k,d}/f_{k,d})=1200[o_d/12-\log_2(N_d)],\ d\epsilon[3\ldots 9]. \tag{13}$$

The tuning error of each tonewheel frequency is independent of k; it depends only on the drawbar index d, i.e., which overtone it is supposed to be approximating. These errors are given for each drawbar in Table 1. For the fundamental and octave overtones, the tonewheels are perfectly in tune. For the 12th and 19th, the tonewheels are approximately −1.955 cents flat of the ideal overtones. The 19th is approximately 13.686 cents sharp. This detuning is very unique to the Hammond organ.

Modal Processor Review

The Hammondizer effect involves decomposing an input signal into a parallel set of narrow-band signals, analogous to a bank of organ keys. Each of the "keys" is then pitch processed according to the drawbar settings, and distortion processed according to the tonewheel and pickup mechanics and electromagnetics. It turns out this structure closely resembles that of the modal reverberator (see, e.g., J. S. Abel, S. Coffin, and K. S. Spratt, "A modal architecture for artificial reverberation," The Journal of the Acoustical Society of America, 134(5):4220, 2013; J. S. Abel, S. Coffin, and K. S. Spratt, "A modal architecture for artificial reverberation with application to room acoustics modeling," Proceedings of the 137th Convention of the Audio Engineering Society (AES), Los Angeles, Calif., Oct. 9-12, 2014) which forms a room response as the parallel combination of room vibrational mode responses. In the following, the disclosure reviews the modal reverberator and adapt it to produce the needed pitch and distortion processing.

Figure 3:
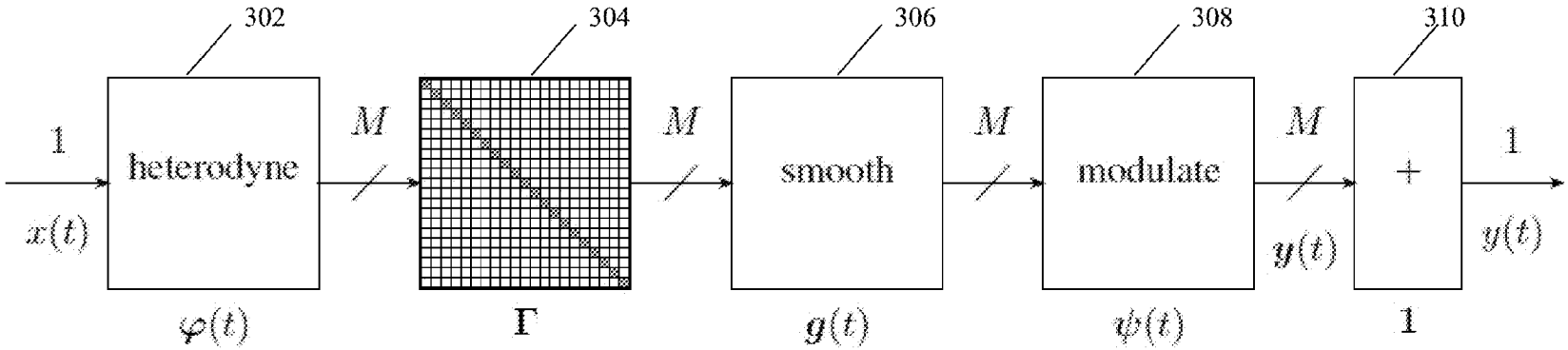
FIG. 3 is a block diagram of a Basic Modal Reverberator Architecture according to embodiments. The modal reverberator is the parallel combination of resonant filters matched to the modes of a linear system.

The impulse response h(t) between a pair of points in an acoustic space may be expressed as the linear combination of normal mode responses (see, e.g., N. H. Fletcher and T. D. Rossing, "Physics of Musical Instruments," Springer, 2nd edition, 2010; P. M. Morse and K. U. Ingard, "Theoretical acoustics," Princeton University Press, 1987), $$h(t)=\sum_{m=1}^{M}h_m(t) \tag{14}$$

where the system has M modes, with the mth mode response denoted by $h_m(t)$. The system output y(t) in response to an input x(t), the convolution y(t)=h(t)*x(t), is therefore the sum of mode outputs $$y(t)=\sum_{m=1}^{M}y_m(t),\ y_m(t)=h_m(t)*x(t) \tag{15}$$

where the mth mode output $y_m(t)$ is the mth mode response convolved with the input. The modal reverberator simply implements this parallel combination of mode responses (15), as shown in FIG. 3 and to be described in more detail below.

Denoting by h(t) the M-tall column of complex mode responses, we have $$y(t)=1^T(h(t)*x(t)) \tag{16}$$

with $$h(t)=\psi(t)\circ(g(t)*\Gamma\varphi(r(t))) \tag{17}$$

and where convolution here obeys the rules of matrix multiplication, with each individual matrix operation replaced by a convolution.

The mode responses $h_m(t)$ are complex exponentials, each characterized by a mode frequency $\omega_m=2\pi f_w$ mode damping $\alpha_m$ and mode complex amplitude $y_m$, $$h_m(t)=\gamma_m\exp\{(j\omega_m-\alpha_m)t \tag{18}$$

The mode frequencies and dampings are properties of the room or object; the mode amplitudes are determined by the sound source and listener positions (driver and pick-up positions for an electro-mechanical device), according to the mode spatial patterns.

Rearranging terms in the convolution $y_m(t)=h_m(t)*x(t)$, the mode filtering is seen to heterodyne the input signal to dc to form a baseband response, smooth this baseband response by convolution with an exponential, and modulate the result back to the original mode frequency, $$y_m(t)=\sum_{\tau}e^{(j\omega_m-\alpha_m)(i-\tau)}x(\tau)=e^{j\omega_m t}\sum_{\tau}\gamma_m e^{-\alpha_m(t-\tau)}[e^{-j\omega_m\tau}x(\tau)] \tag{19}$$

Figure 4:
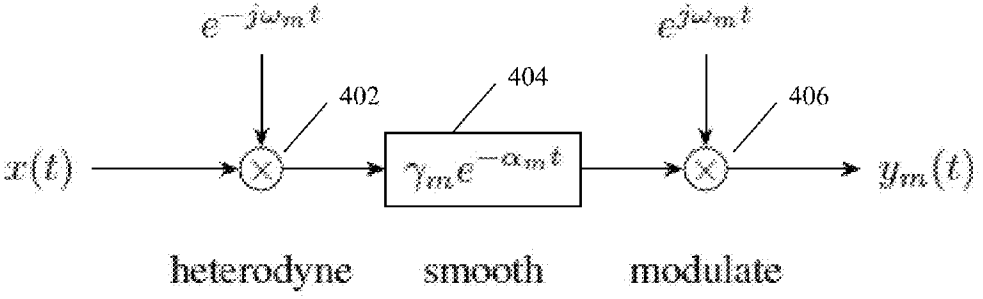
FIG. 4 is a diagram of a Mode Response Implementation according to embodiments. The mode response may be implemented as a cascade of heterodyning, smoothing and modulation operations.

All M γs are stacked into a diagonal gain matrix Γ 304. All the heterodyning sinusoids are stacked into a column ω(t) 302 and all of the modulating sinusoids into a column ψ(t) 308. The mode damping filters are stacked into a column g(t) 306, as shown in FIG. 3. As show in alternate detail in FIG. 4, the heterodyning 402 and modulation 406 steps implement the mode frequency, and the smoothing filter 404 generates the mode envelope, an exponential decay.

Using this architecture, rooms and objects may be simulated by tuning the filter resonant frequencies and dampings to the corresponding room or object mode frequencies and decay times. The parallel structure allows the mode parameters to be separately adjusted, while (19) provides interactive parameter control with no computational latency.

As described in, for example, J. S. Abel and K. J. Werner, "Distortion and pitch processing using a modal reverb architecture," Proceeding of the 18th International Conference on Digital Audio Effects (DAFx-15), Trondheim, Norway, Nov. 30-Dec. 3, 2015., the modal reverberator architecture can be adapted to produce pitch shifting by using different sinusoid frequencies for the heterodyning and modulation steps in (19) and adapted to produce distortion effects by inserting nonlinearities on the output of each mode or group of modes. The modal processor architecture has been used for other effects including mode-wise gated reverb using truncated IIR (TIIR) filters (see, e.g., A. Wang and J. O. Smith, "On fast FIR filters implemented as tail-canceling IIR filters," IEEE Transactions on Signal Processing, 45(6):1415-1427, 1997.), groupwise distortion, time stretching by resampling of the baseband signals, and manipulation of mode time envelopes by introducing repeated poles (see, e.g., J. S. Abel and K. J. Werner, "Distortion and pitch processing using a modal reverb architecture," Proceeding of the 18th International Conference on Digital Audio Effects (DAFx-15), Trondheim, Norway, Nov. 30-Dec. 3, 2015).

Hammondizer Modal Processor Implementation

Figure 5:
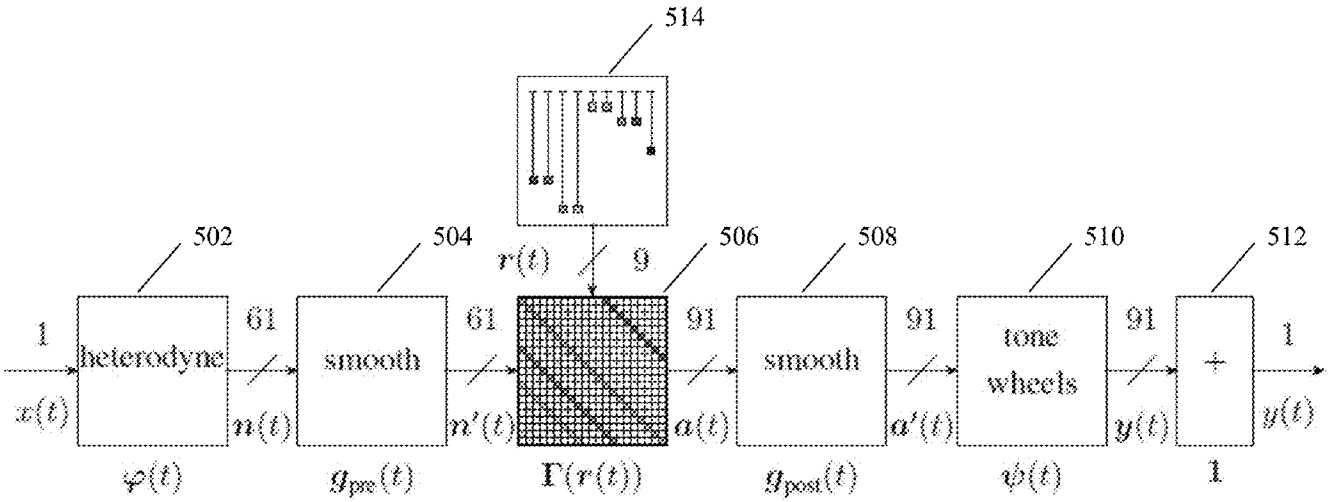
FIG. 5 is a block diagram of the Hammondizer effect according to embodiments.

An example Hammondizer effect system architecture according to embodiments is shown in FIG. 5. It turns out this structure closely resembles that of the modal reverberator (FIG. 3), which forms a room response as the parallel combination of room vibrational mode responses. Both have inputs designated by x(t), a column of narrow-band outputs designated by y(t), summed to form the system output y(t).

In the Hammondizer, the input signal x(t) is heterodyned to baseband by a column of modulating sinusoids φ(t) 502:

$$n(t)=\varphi(t)x(t) \tag{20}$$

These baseband signals are smoothed by a column of pre-smoothing filters $g_{pre}(t)$ 504

$$n'(t)=g_{pre}(t)*n(t) \tag{21}$$

A column of tonewheel amplitudes a(t) is formed by the drawbar routing matrix Γ(r(t)) 506, $$a(t)=\Gamma(r(t))n'(t) \tag{22}$$

and further smoothed by a column of post-smoothing filters $g_{post}(t)$ 508:

$$a'(t)=g_{post}(t)*a(t) \tag{23}$$

A set of mode outputs y(t) is formed by the tonewheel processing stages ψ(t) 510 which include a column of pickup models p(•) and modulating signals x(t)

$$y(t)=p(x(t)\circ a'(t)) \tag{24}$$

Figure 6:
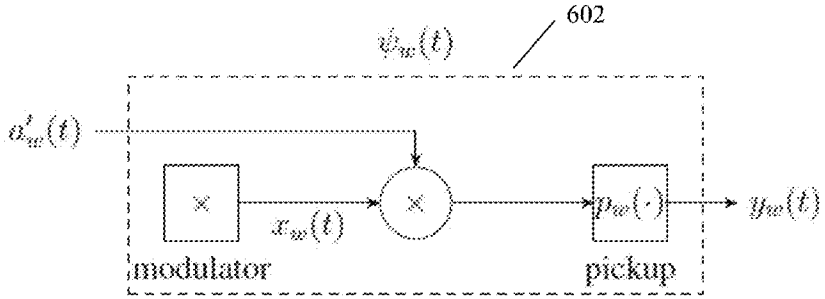
FIG. 6 is a block diagram of one tonewheel processor in the Hammondizer according to embodiments.

An individual tonewheel processing stage 602 is shown in FIG. 6. Notice the slight change in architecture from the analogous FIG. 2. In FIG. 6, the pickup distortion 606 has been moved to operate on the output rather than the raw tonewheel signal. The reason for this change is artistic—it disambiguates the effects of the memoryless pickup nonlinearities and the distortion of the tonewheel basis functions.

Finally the output y(t) is formed by summing 512 all of the mode outputs:

$$y(t)=1^T y(t) \tag{25}$$

In the rest of this section, the disclosure describes in detail how aspects of the modal processor are tuned and adapted to create the Hammondizer. As described in the examples below, pitch processing adaptations include tuning the modes to the particular frequencies and frequency range of the Hammond organ, introducing drawbar-style controls to pitch processing, adding vibrato to mode frequencies, and adding crosstalk between nearby modes to simulate crosstalk between nearby tonewheels. Distortion processing adaptations include adapting saturating nonlinearities for each mode to mimic the pickup distortion of each tonewheel and replacing modulation sinusoids with sums of sinusoids to mimic non-sinusoidal tonewheel shapes.

Frequency Range

The first step of adapting the modal reverberator to create the Hammondizer effect is to pick the mode frequencies which specify the heterodyning and modulating sinusoids φ(t) and ψ(t). The unique sound of the Hammond organ is largely due to the tonewheels being tuned to the 12-tone equal tempered scale. The following is an example of how to preserve this feature in the context of the Hammondizer audio effect.

Since each mode of the modal reverberator is a narrow bandpass filter, a sufficient frequency density of modes is required to support typical wideband musical signals. In particular, unless each frequency component of the input is sufficiently close to a mode center, it may not contribute audibly to the output.

For this reason, tuning the modal reverberator's frequencies to the 12-tone equal tempered scale used by the Hammond organ heavily attenuates the frequencies "in the cracks," producing an artificial sound (compare to composer Peter Ablinger's "Talking Piano," G. D. Barrett, "Between noise and language: The sound installations and music of Peter Ablinger," Mosaic: a Journal for the Interdisciplinary Study of Literature, 42(2):147-164, December 2009.).

To avoid this effect, embodiments use many exponentially-spaced mode frequencies per semitone. Denoting the number of modes per semitone as S, the tuning of each mode is $$f_w=f_1\cdot 2^{w/(12S)}\ \text{Hz} \tag{26}$$

(cf. (2)). S is chosen to satisfy two subjective constraints. As S gets larger, the computational cost of the modal processor grows. As S becomes small, the modal density decreases and produces an artificial sound. The present applicants found by experimentation that S=14 is a good setting that balances these two constraints.

Heterodyning and modulating sinusoids at constant frequencies are given by $$\varphi_w(t)=\exp\{-jw_w t\} \tag{27}$$

$$\varphi_w(t)=\exp\{+jw_w t\} \tag{28}$$

(cf. (18)).

The next step of adapting the modal reverberator to create the Hammondizer effect is to choose the range of mode frequencies. The range of the Hammond organ is C1 (approximately 32.7 Hz) to F#7 (approximately 5919.9 Hz). For simplicity, embodiments set $f_1$=40 Hz and let the modes range up 7 octaves, up to $f_{1177}$=5120 Hz; these 162 modes are indexed by a tonewheel index w which is an element of the set of [1 . . . 177]. These round numbers correspond very closely to the range of the Hammond organ. 40 Hz corresponds to k is approximately 3.5 and 5120 Hz to k being approximately 87.5; therefore this range technically cuts off approximately 3 semitones from the top and bottom of the range of the Hammond organ tonewheel range. Nonetheless, it does not negatively affect the qualitative effect of the Hammondizer.

Tone Controls

The heart of the Hammondizer effect is the drawbar tone controls. As before, the drawbar settings 514 give a column r of registrations, which drive the entries of the sparse matrix T(r(t)) according to $$y_{k,w}(t)=\sum_{d=1}^{9}\tau_d(t)\cdot\delta(w-k-o_d\cdot S) \tag{29}$$

The only difference from (5) is the presence of S to account for the multiple modes per semitone.

In the Hammondizer context, the entries in T(r(t)) control a Hammond-style pitch shift. The structure of T(r(t)) means that energy in a smoothed baseband signal $n_w(t)$ (centered at some mode frequency $f_w$) contributes to nine different tonewheel amplitudes $f_k$. k is an element of the set of $1w+S_o$, according to $\gamma_{k,w}(t)$.

Vibrato

A vibrato effect which can mimic Hammond organ vibrato is created when the frequencies of the modulating sinusoids ψ(t) are varied. In this case, modulation sinusoids can be implemented with phase accumulators $$x_w(t)=\exp\{-jk\theta_w(t)\} \tag{30}$$

Each vibrato phase signal is given by $$\theta_w(t)=\theta_w(t-1)+2^{V_{depth}/1200-\sin(2\pi/f_s V_{rate}t)}2\pi/f_s \tag{31}$$

where $V_{depth}$ is the vibrato depth in cents and $V_{rate}$ is the vibrato rate in Hz.

An early Hammond patent (J. M. Hanert, "Electrical musical apparatus," Aug. 14, 1945, U.S. Pat. No. 2,382,413) praises " . . . a musical tone containing a vibrato, that is, a cyclical shift in frequency of approximately 1.5%, at a rate of about 6 per second . . . ." To match that design criteria, we typically choose a vibrato depth of 26 cents, which is approximately 1.5% and a vibrato rate of 6 Hz. Of course, these can be parameterized as desired.

Crosstalk

Some aficionados point to crosstalk between tonewheels as an important part of Hammond organ sonics. Embodiments consider that since mode filters are not "brick wall" filters, there is already a sort of crosstalk built into the Hammondizer effect.

Drawing inspiration from Pekonen et al. (see, e.g., J. Pekonen, T. Pihlajamäki, and V. Välimäki, "Computationally efficient Hammond organ synthesis," Proceedings of the 14th International Conference on Digital Audio Effects (DAFx-11), Paris, France, Sep. 19-23, 2011), embodiments explicitly simulate leakage between adjacent tonewheels by adding another matrix multiply between $g_{post}(t)$ and ψ(t). This creates a new set of signals with crosstalk that includes modes one semitone away from the main modes with a crosstalk level C:

$$a_w''(t)=Ca_{w-S}'(t)+a_w'(t)+Ca_{w+S}(t) \tag{32}$$

Memoryless Pickup Nonlinearities

As detailed in J. S. Abel and K. J. Werner, "Distortion and pitch processing using a modal reverb architecture," Proceeding of the 18th International Conference on Digital Audio Effects (DAFx-15), Trondheim, Norway, Nov. 30-Dec. 3, 2015, distortion effects may be generated by passing a mode through a memoryless nonlinear function or by substituting a complex waveform for the modulation sinusoid waveform. Here, embodiments adapt both types of distortion to mimic aspects of the Hammond organ's sonics and design to the Hammondizer. Note that since both kinds of distortion is applied separately to each mode, the output will contain no intermodulation products.

Drawing inspiration from the Mustonen et al. model of a guitar pickup (see, e.g., M. Mustonen, D. Kartofelev, A. Stulov, and V. Välimäki, "Experimental verification of pickup Nonlinearity," Proceedings of the International Symposium on Musical Acoustics (ISMA), pages 651-656, Le Mans, France, Jul. 7-12, 2014), embodiments introduce a memoryless nonlinearity of the form $$y_w(t)=(1-e^{-ax_w(t)a_w'(t)})/a \tag{33}$$

Figure 7:
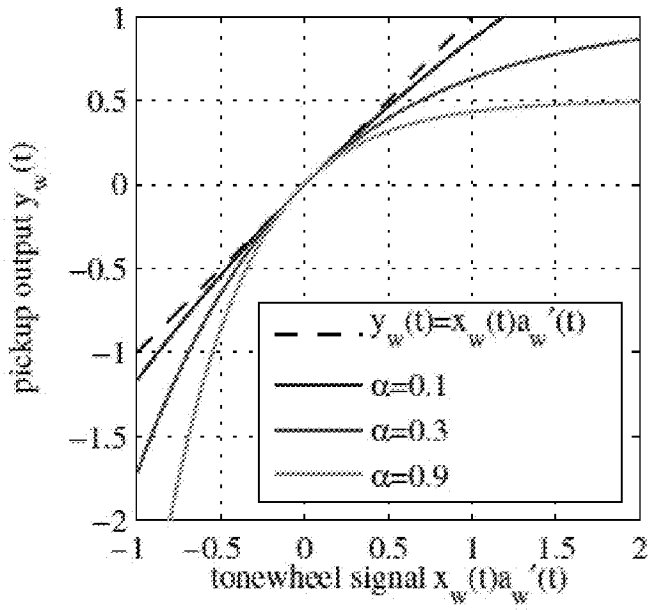
FIG. 7 is a graph illustrating memoryless tonewheel pickup nonlinearity according to embodiments.

This memoryless nonlinearity is shown for values of a which is an element of the set of [0.1, 0.3, 0.9] in FIG. 7. This has the property of maintaining unity gain around zero, but distorting signals with a large swing around zero by compressing positive signals and expanding negative signals. In this article, we will use a value of a=0.3.

Typically, memoryless nonlinearities like this will produce effects including "harmonic distortion" (new frequencies at multiples of existing frequencies) and "intermodulation products" (new frequencies at sums and differences of existing frequencies). Since this memoryless nonlinearity is applied to the output of a bandpass filter, mostly harmonic distortion will be created, since energy is concentrated at one frequency.

Tonewheel Basis Distortion

On the Hammond organ, tonewheels may not be perfectly sinusoidal. Also, the lowest octave of tonewheels are cut closer to a square wave shape than a sinusoid. This can be considered a distortion of the sinusoidal basis functions that the tonewheels represent. To approximate this distortion of the lower tonewheel basis functions, we can replace each modulating sinusoid $\psi_w(t)$ with a sum of sinusoids $$\tilde{\psi}_w(t)=\frac{4}{\pi}\exp(jw_w\cdot t)+\frac{4}{3\pi}\exp(j3f_w\cdot t)+\frac{4}{5\pi}\exp(j5f_w\cdot t) \tag{34}$$

(cf. (10).)

Drawing inspiration from the Hammond organ, this should be done for the lowest octave of tonewheels. In practice, it can be useful to define the effect for a large range of modes.

Note that this distortion is very different in character from the saturating nonlinearities. Specifically, it has the unique feature of being amplitude-independent.

Results and Discussion

To demonstrate the features of the Hammondizer according to embodiments, the present applicants have produced a series of examples. Examples of the pitch processing and distortion processing Hammondizer components, operating on a pure tone input, are presented, examples of the full Hammondizer, applied to program material, are described, and aspects of the Hammondizer's sonics are visible in the spectrograms in the figures and explained in the text. To understand the full effect of the Hammondizer, it may be useful to listen to it. Audio recordings (.wav file format) of all these examples are available online at ccrma.stanford.edu/~kwerner/appliedsciences/hammondizer.html.

For all of these examples, the Hammondizer is configured to have 1177 exponentially spaced modes, with 14 modes per semitone over the seven octave range from 40 Hz to 5120 Hz. The two vectors of smoothing operations $g_{pre}(t)$ and $g_{post}(t)$ are set so that the gain of each mode during the smoothing operations is set to unity. $g_{pre}(t)$ is simply a column of ones. Except where noted, each mode is assigned a 200-ms decay time. Embodiments form $g_{post}(t)$ using smoothing filters which are applied twice, as suggested in J. S. Abel and K. J. Werner, "Distortion and pitch processing using a modal reverb architecture," Proceeding of the 18th International Conference on Digital Audio Effects (DAFx-15), Trondheim, Norway, Nov. 30-Dec. 3, 2015. This creates impulse responses with a linear ramp onset and a 200-ms decay (see, e.g., J. S. Abel and M. J. Wilson, "Luciverb: Iterated convolution for the impatient," Audio Engineering Convention, volume 133, San Francisco, Calif., Oct. 26-29, 2012), i.e., of the form t exp{−at}.

Although the variation of the mode dampings and complex amplitudes has not been emphasized herein, focusing rather on the novel aspects of the Hammondizer, the mode dampings and complex amplitudes can be set just as in the modal reverberator (see, e.g., J. S. Abel, S. Coffin, and K. S. Spratt, "A modal architecture for artificial reverberation," The Journal of the Acoustical Society of America, 134(5): 4220, 2013; J. S. Abel, S. Coffin, and K. S. Spratt, "A modal architecture for artificial reverberation with application to room acoustics modeling," Proceedings of the 137th Convention of the Audio Engineering Society (AES), Los Angeles, Calif., Oct. 9-12, 2014), creating hybrid Hammond/reverb effects.

Pitch Processing Examples

Figure 8:
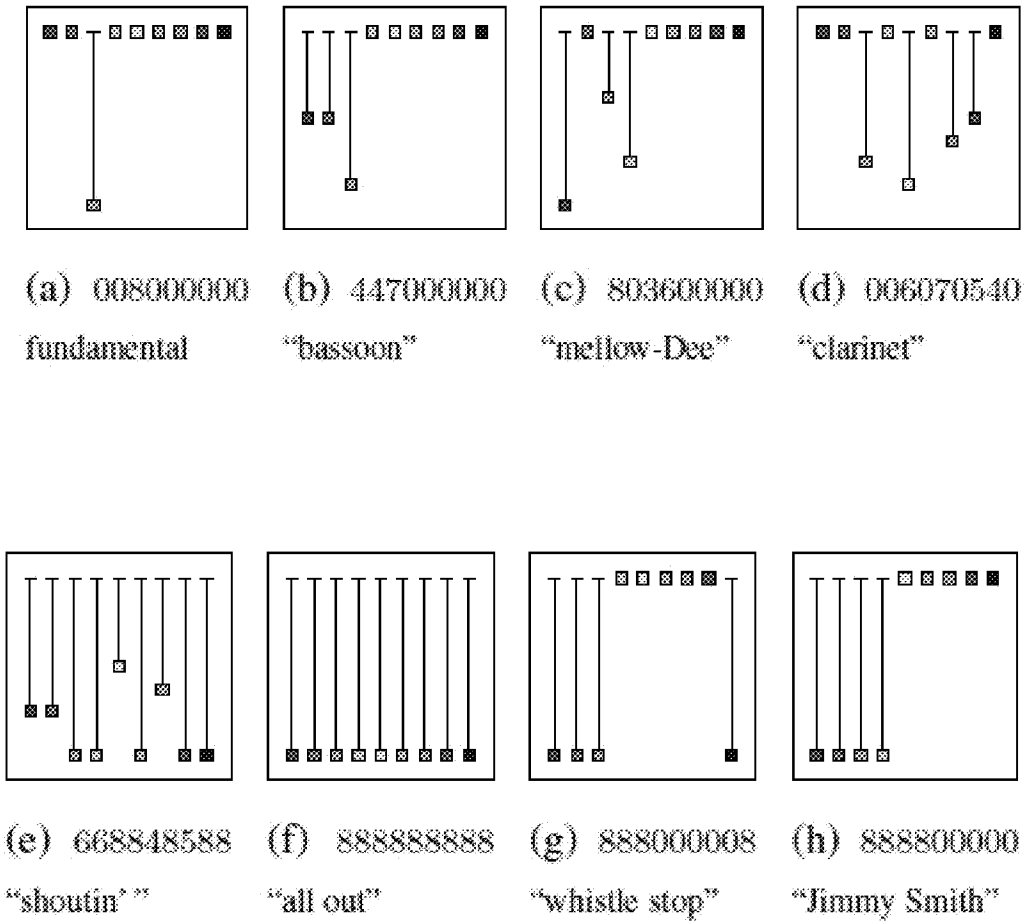
FIG. 8 illustrates various Hammond organ registrations and their names.
Figure 9B:
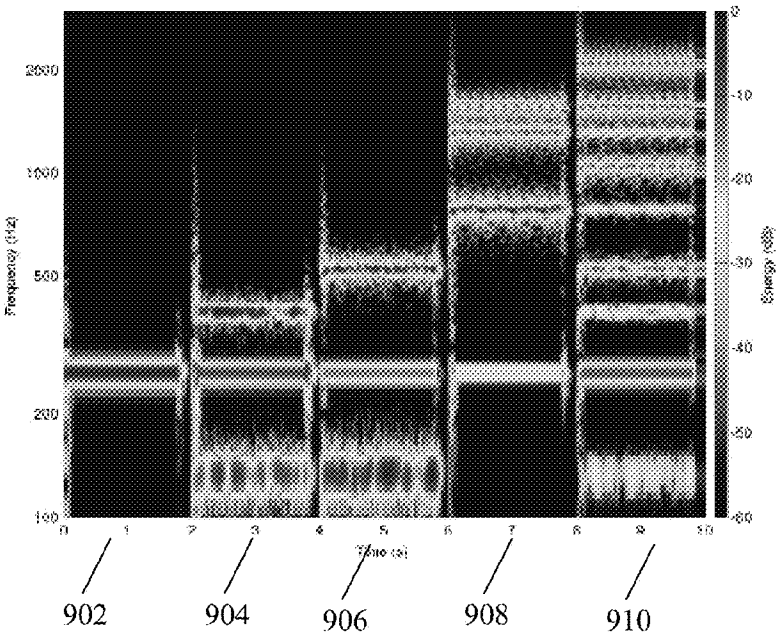
FIGS. 9(*a*) and 9(*b*) show spectrograms of a pure tone input signal and versions processed with the Hammondizer according to embodiments.
Figure 9A:
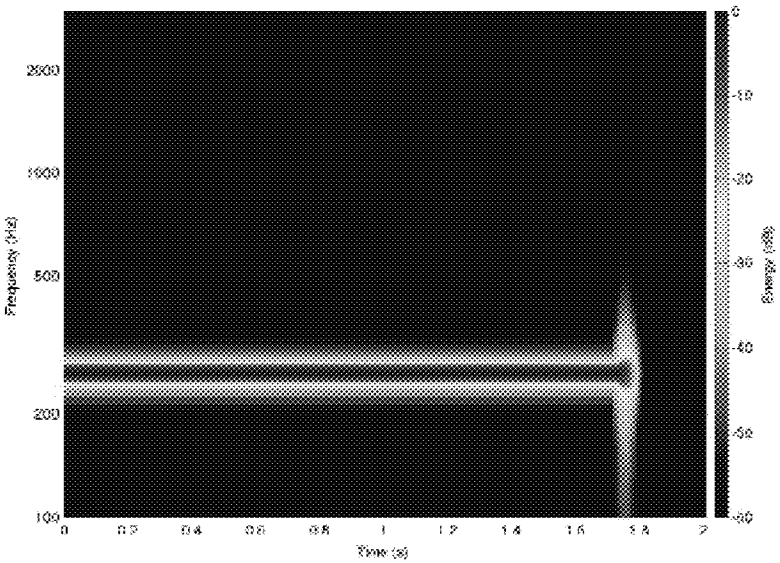

In this section, illustrated are examples of the Hammondizer's drawbar tone controls, its frequency range, and crosstalk and vibrato processing according to embodiments. More particularly, FIGS. 9(*a*) and 9(*b*) show spectrograms of a pure tone input signal and versions processed with the Hammondizer. The input signal (FIG. 9(*a*)) is a 1.75-second-long sine wave tuned to middle C (C3, which is approximately 261.63 Hz). The output signal (FIG. 9(*b*)) shows five different Hammondized versions 902, 904, 906, 908 and 910 of the input signal. Each of the five versions uses a different registration; the vibrato, crosstalk, and distortion were disabled. The different Hammond organ registrations shown in these results are given in FIG. 8. FIG. 9(*b*) uses the first five registrations shown in FIG. 8 in order (the registrations in these examples are taken from a Hammond owner's manual (H. Suzuki, "Model: Sk1/sk2 stage keyboard owner's manual," Technical report) and a Keyboard Magazine article (M. Finnigan, "5 great B-3 drawbar settings," Keyboard Magazine, Oct. 4, 2012).

The C3 sine wave is tuned very close to the center frequency of mode w=455. Knowing that the Hammondizer uses the matrix T(r(t)) to drive output modes that are offset from each analysis mode by the length-9 column o (recall Table 1 and (1)), it can be expected that an input consisting of a single sinusoid will in general create output signals with nine sinusoidal components (recall (11)) near modes [287, 553, 455, 623, 721, 791, 847, 889, 959]. However, since T(r(t)) is a function of the registration r(t), the output behavior is heavily dependent on the registration. Notice that the 008000000 registration 902 does not affect the signal much beyond a slight lengthening due to the decay time of the modes near C3. Since each r(t) except $r_3(t)$ is zero, only one sinusoid comes out. The second setting 904, "bassoon" (447000000) produces three sinusoids in response to the input sinusoid since it has three non-zero r(t)s. The amplitude of each sinusoid depends on its corresponding drawbar setting (recall Table 2). The "bassoon" 904, "mellow-Dee" 906, and "shoutin'" 908 registrations have non-0 first drawbar settings—notice that they produce energy an octave below C3. The "shoutin'" 908 and "all out" 910 registrations have no non-0 drawbar settings—notice that the individual sine wave of the input has driven nine sine waves 912 in the output, and that their relative amplitudes reflect the "shoutin'" and "all out" registrations (66/884,8588 and 888888888, respectively).

Figure 10B:
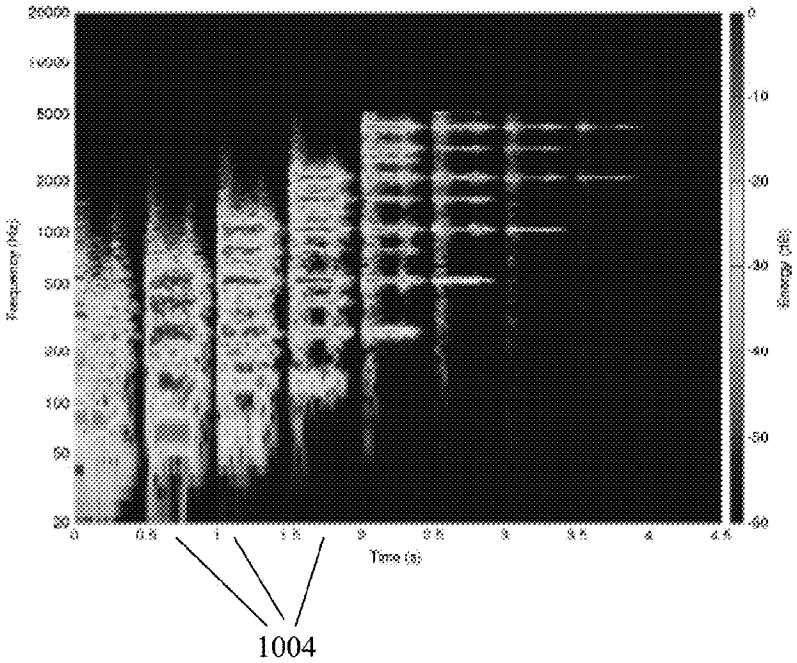
FIGS. 10(*a*) and 10(*b*) show spectrograms of a sinusoidal input signal and its Hammondized response, respectively, according to embodiments.
Figure 10A:
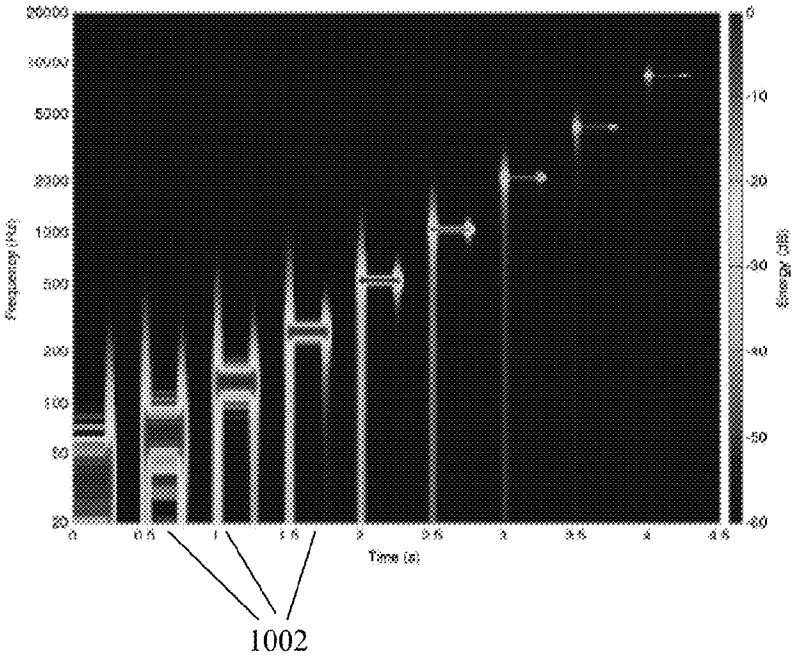

FIGS. 10(*a*) and 10(*b*) show spectrograms of a sinusoidal input signal and its Hammondized response, respectively. The input signal (FIG. 10(*a*)) is a series of nine 0.5-second-long sine waves 1002, generated at octave intervals from C0 (approximately 32.70 Hz) and to C8 (approximately 8372.02 Hz). The Hammondized output 1004 (FIG. 10(*a*)) used the 66/884,8588 ("shoutin'") registration, and the vibrato, crosstalk, and distortion were disabled. In a broad sense the Hammondizer imprints the "shoutin'" partial structure onto the input sinusoids. Note however, that since the Hammondizer does not have any modes outside the 40 Hz to 5120 Hz frequency range, the C0 and C8 inputs generate little output, though transients in the C0 sinusoid produce a ghostly "whoosh" sound.

Figure 11A:
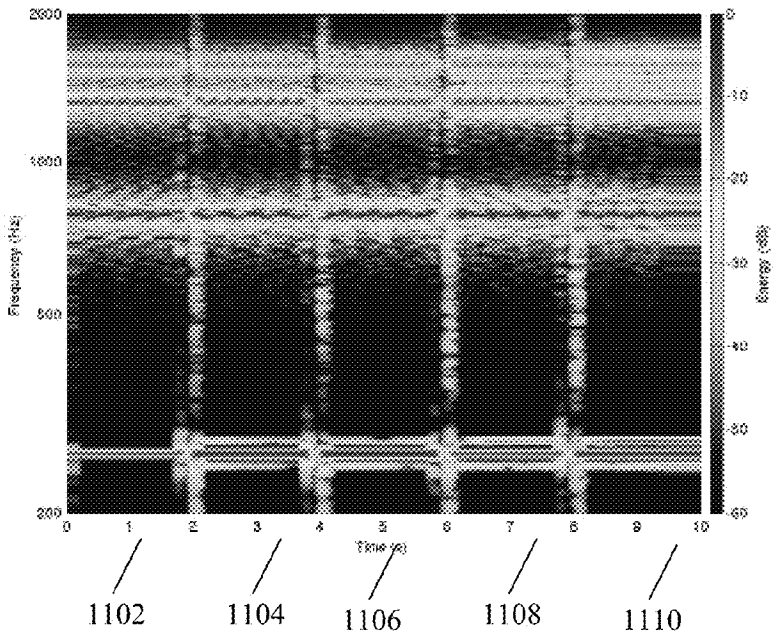
FIGS. 11(*a*) and 11(*b*) show spectrograms illustrating Hammondizer crosstalk and vibrato components using the pure tone input of FIG. 9(*a*) according to embodiments.
Figure 11B:
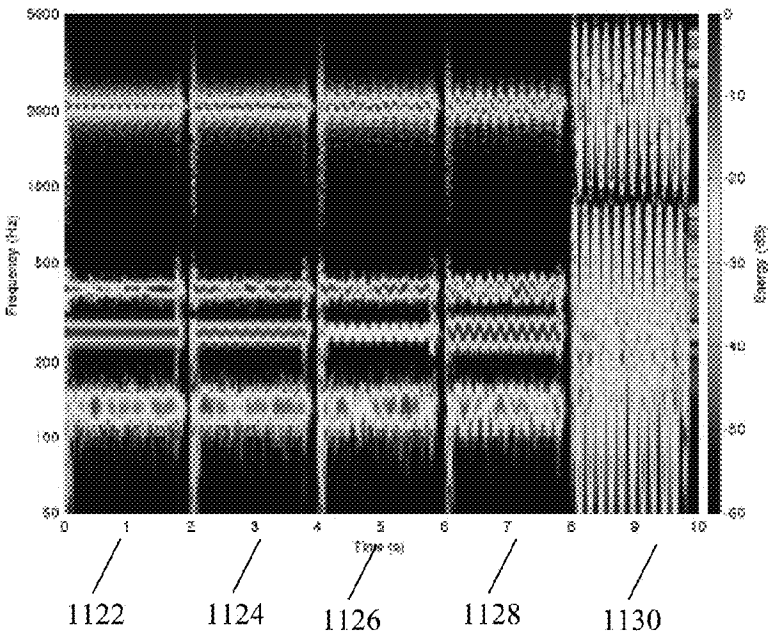

The Hammondizer crosstalk and vibrato components are now explored using the pure tone input of FIG. 9(*a*). In FIG. 11(*a*), the effect of crosstalk is illustrated using the "clarinet" registration with vibrato and distortion disabled. Crosstalk amplitudes of −∞, −24, −18, −12, and 16 dB are simulated in 1102, 1104, 1106, 1108 and 1110, respectively. Note the increased presence of energy in adjacent notes with increased crosstalk amplitude. In FIG. 11(*b*), the effect of vibrato is studied using a "whistle stop" (888000008) registration, with crosstalk and distortion disabled. Each output uses a 6 Hz vibrato, with (from 1122 at the left to 1130 at the right) vibrato depths 258 of 0, 25, 50, 100, and 1200 cents, respectively, with a depth of 25 cents being typical for a Hammond tonewheel organ. As expected, there is a sinusoidal variation in the output frequency of each partial.

Distortion Processing Examples

The following examples demonstrate the Hammondizer's tonewheel shape distortion and its mode-wise distortion according to embodiments.

Figure 12A:
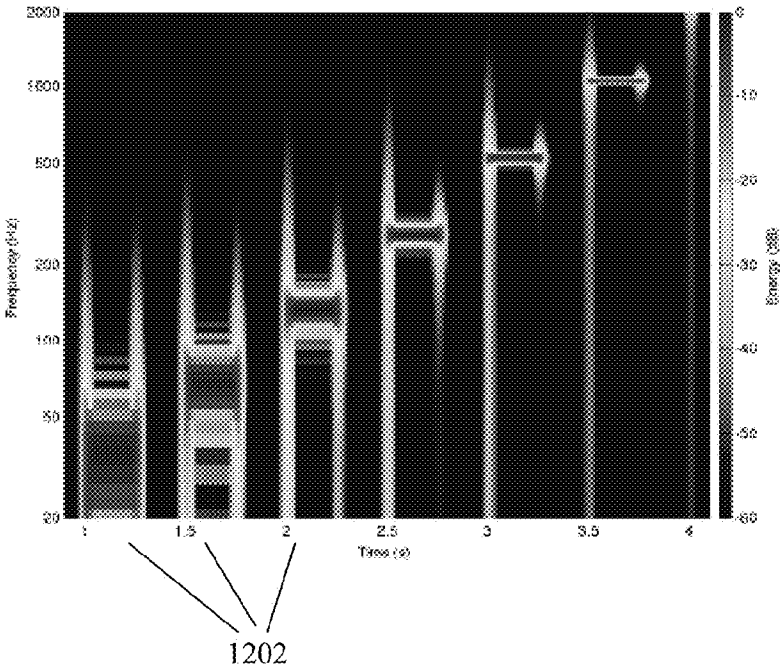
FIGS. 12(*a*) and 12(*b*) show an input signal spectrogram (FIG. 12(*a*)) and a Hammondized version showing the tonewheel shape distortion (FIG. 12(*b*)) according to embodiments.
Figure 12B:
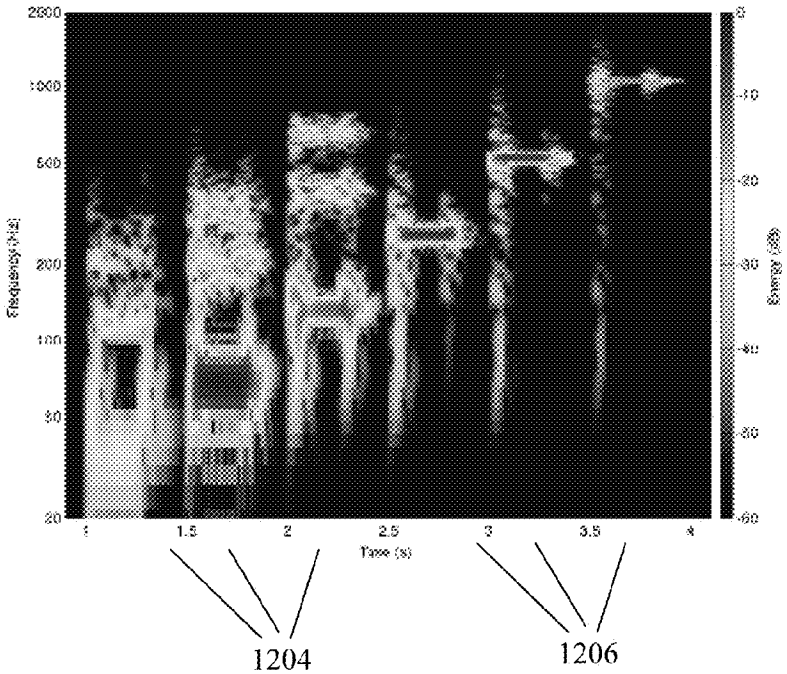

More particularly, FIGS. 12(*a*) and 12(*b*) show an input signal spectrogram (FIG. 12(*a*)) and a Hammondized version showing the tonewheel shape distortion (FIG. 12(*b*)). The input signal is the collection of sinusoids 1202, C0 through C5. This is applied to the Hammondizer set to a fundamental-only registration (008000000), with vibrato and distortion disabled. As described above, the lowest two octaves of tonewheels are given 3rd and 5th harmonics. Notice how C0, C1, C2 produce outputs 1204 pronounced 3rd and 5th harmonics even though the registration is 008000000, but that C3-C5 outputs 1206 don't generate harmonics.

Figure 13B:
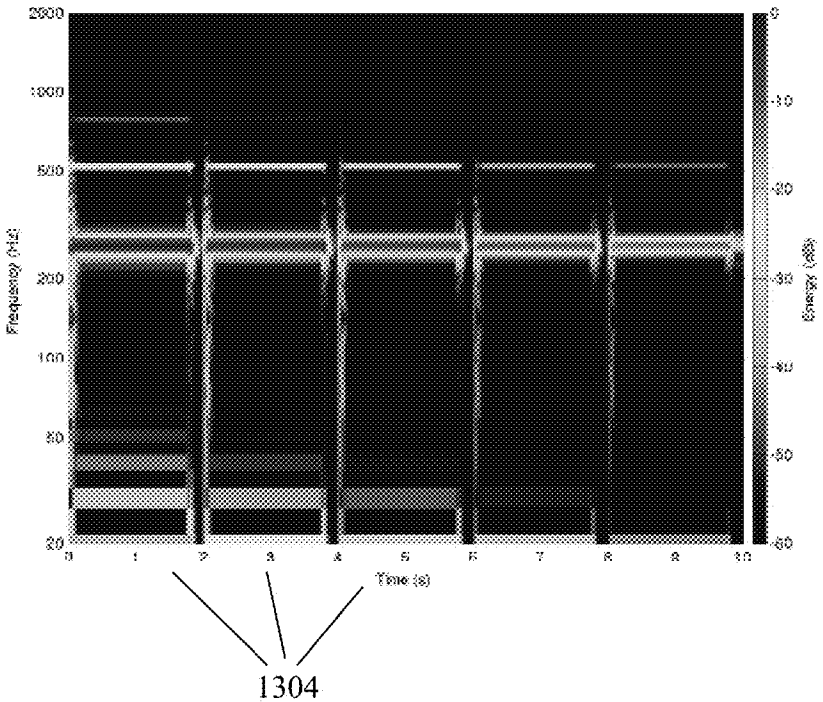
FIGS. 13(*a*) and 13(*b*) show spectrograms of an input signal and its Hammondized version, respectively, according to embodiments.
Figure 13A:
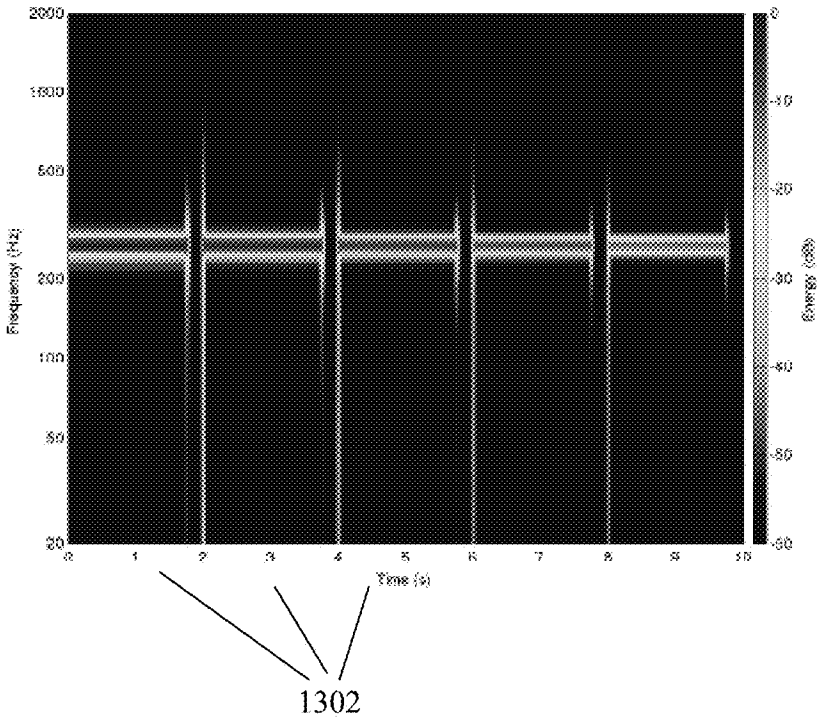

FIGS. 13(*a*) and 13(*b*) show spectrograms of an input signal and its Hammondized version, respectively. FIG. 13(*a*) shows the input signal: five 1.75-second-long sinusoidal bursts 1302, all tuned to C3. From left to right, the input sinusoid amplitudes are 0, −3, −6, −9, and −12 dB. Notice in the output 1304 (FIG. 13(*b*)) that the degree of distortion decreases as the amplitude decreases, as is typical of saturating memoryless nonlinearities.

Recall that the Hammond distortion is generated separately on each key, and accordingly there is no intermodulation distortion. To demonstrate this and to test the presence of intermodulation distortion in embodiments of the Hammondizer process, examples use a signal 1402 having C3 and E3 notes which appear both individually and overlapped. FIG. 14(*b*) shows the Hammondized result 1404. Notice that there is little to no intermodulation distortion in the output; the response to the combination of C3 and E3 is very nearly equal to the sum of the response to C3 and the response to E3. FIG. 14(*c*) shows the result 1406 of a modified algorithm $y(t)=p(1^T(x(t)\circ a'(t)))$ in which the hundreds of individual mode pickup distortions are replaced by a single pickup distortion that operates on the sum of all modes. (c.f. (24)-(25).) This more typical approach to implementing distortion produces heavy intermodulation distortion. This sort of intermodulation distortion can be considered unpleasant; its absence can be considered a unique feature of the Hammondizer.

Full Examples

Figures 16A, 16B, 16C:
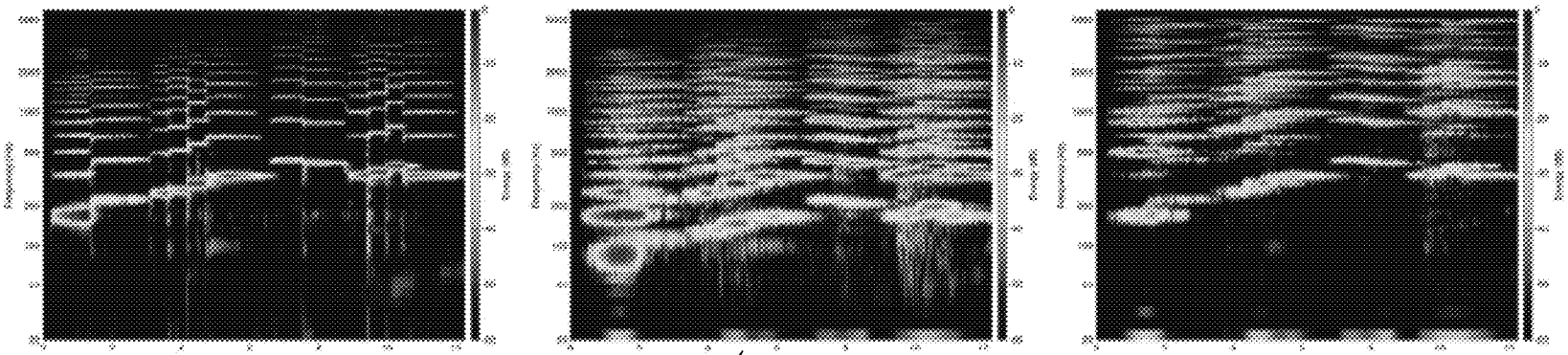
FIGS. 16(*a*) to 16(*c*) are spectrograms illustrating full Hammondizer processing program material with a violoncello according to embodiments.

This section provides examples of the full Hammondizer processing program material, a guitar (FIG. 15) and a violoncello (FIG. 16).

FIG. 15(*a*) shows a blues guitar lick 1502, and two Hammondized versions, with a "Jimmy Smith" (888800000) registration in FIG. 15(*b*) and an "all out" (888800000) registration in FIG. 15(*c*). Notice that the relatively full-range input 1502 of the guitar is mostly restricted to below 5120 Hz in the Hammondized examples 1504 and 1506. Especially from 1-2 seconds, the vibrato is visible. In the "all out" registration 1506 some pickup distortion is visible above the 5120-Hz tonewheel limit.

FIG. 16(*a*) shows a melody 1602, more particularly "El Cant dels Ocells," played on the violoncello, and two Hammondized versions, with a "bassoon" (447000000) registration 1604 in FIG. 16(*b*) and a "clarinet" (006070540) registration 1606 in FIG. 16(*c*).

CONCLUSION

According to some aspects, the present disclosure describes a novel class of audio effects—the Hammondizer—that imprint the sonics of the Hammond tonewheel organ on any audio signal. The Hammondizer extends the recently-introduced modal processor approach to artificial reverberation and effects processing. The following describes two possible extensions to the Hammondizer audio effect.

The preceding sections presented parameterizations of each aspect of the Hammondizer which are chosen to mimic the sonics of the Hammond organ closely. For example the mode frequency range of the Hammondizer is chosen to match the range of tonewheel tunings on the Hammond organ and the the vibrato rate and depth are chosen to mimic a standard Hammond organ vibrato tone. The present applicants recognize that these parameterizations can be extended so as to loosen the connection to the Hammond organ but widen the range of applicability of the Hammondizer. For instance, the mode frequencies can be tuned across the entire audio range rather than being limited to 40-5120 Hz. In this context, some of the Hammond organ is relaxed, but the drawbar controls still give a powerful and unique interface for pitch shift in a reverberant context.

Although the Hammondizer is designed to process complex program material as a digital audio effect, it is possible to configure the Hammondizer so that it will act somewhat like a direct Hammond organ emulation. This can be done by driving the Hammondizer with only sinusoids (e.g. a keyboard set to a sinusoid tone) which act as control signals effectively driving n(t) directly. This is particularly effective using short mode dampings (as in the present disclosure). An example is given alongside the other audio online at ccrma.stanford.edu/~kwerner/appliedsciences/hammondizer.html.

Although the present embodiments have been particularly described with reference to preferred ones thereof, it should be readily apparent to those of ordinary skill in the art that changes and modifications in the form and details may be made without departing from the spirit and scope of the present disclosure. It is intended that the appended claims encompass such changes and modifications.

What is claimed is:

1. A method of simulating the sound of an electromechanical musical instrument having a plurality of tonewheels and at least one drawbar, the at least one drawbar having a plurality of settings, each of the settings having an associated pitch shift, the method comprising:

generating an audio signal corresponding to the simulated sound as the sum of resonant filter responses, the generating including:

forming a plurality of heterodyned signals corresponding to a first set of mode frequencies, producing mixed signals by mixing the heterodyned signals according to the plurality of drawbar settings, and modulating the mixed signals according to a second set of mode frequencies.

2. The method of claim 1, wherein one or both of the first set of mode frequencies are equal-tempered.

3. The method of claim 1, wherein the first and second set of mode frequencies are the same.

4. A method for processing an audio signal according to at least one drawbar setting, each drawbar setting having an associated pitch shift, the method comprising:

forming heterodyned signals by heterodyning the audio signal according to a first plurality of mode frequencies;

producing mixed signals by mixing the heterodyned signals according to the at least one drawbar setting; and modulating the mixed signals according to a second plurality of mode frequencies.

5. The method of claim 4, wherein one or both of the first set of mode frequencies are equal-tempered.

6. The method of claim 4, further comprising applying vibrato to the audio signal.

7. The method of claim 6, wherein applying vibrato includes varying at least one of the second plurality of mode frequencies over time.

8. The method of claim 4, further comprising applying non-linear distortion to the audio signal.

9. The method of claim 4, wherein at least one of the second plurality of mode frequencies is associated with a sinusoidal modulating signal.

10. The method of claim 4, wherein at least one of the second plurality of mode frequencies is associated with a non-sinusoidal modulating signal.

11. A method for synthesizing a sound described by parameters including the pitch of the sound, and at least one drawbar setting having an associated pitch shift, the method comprising:

generating a tone according to the pitch of the sound;

producing a set of mixed signals corresponding to the tone that is pitch shifted according to the at least one drawbar setting; and modulating the mixed signals according to a plurality of mode frequencies.

12. The method of claim 11, further comprising applying vibrato to the sound.

13. The method of claim 11, wherein the generated tone mimics a distorted sinusoid produced by a tonewheel of an electromechanical musical instrument.

* * * * *